US006861793B2

(12) United States Patent
Sakurai et al.

(10) Patent No.: US 6,861,793 B2
(45) Date of Patent: Mar. 1, 2005

(54) COLOR PICTURE TUBE DEVICE WITH IMPROVED HORIZONTAL RESOLUTION

(75) Inventors: Hiroshi Sakurai, Takatsuki (JP); Etsuji Tagami, Takatsuki (JP); Kazuo Nakano, Mukou (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 0 days.

(21) Appl. No.: 10/260,162

(22) Filed: Sep. 30, 2002

(65) Prior Publication Data

US 2003/0080670 A1 May 1, 2003

(30) Foreign Application Priority Data

Oct. 1, 2001 (JP) ..... 2001-305531
Jan. 29, 2002 (JP) ..... 2002-019683

(51) Int. Cl.[7] ..... H01J 29/51; H01J 29/76
(52) U.S. Cl. ..... 313/442; 313/412; 313/440
(58) Field of Search ..... 313/440, 431, 313/433, 442, 412, 414; 315/368.27, 368.28; 335/210, 213, 214

(56) References Cited

U.S. PATENT DOCUMENTS

| | | | | |
|---|---|---|---|---|
| 3,430,099 A | | 2/1969 | Ashley | |
| 4,231,009 A | | 10/1980 | Barkow | |
| 4,433,268 A | * | 2/1984 | Arisato | 313/440 |
| 4,988,926 A | | 1/1991 | Sluyterman et al. | |
| 5,027,042 A | | 6/1991 | Sluyterman et al. | |
| 5,455,483 A | * | 10/1995 | Azzi et al. | 313/440 |
| 5,565,732 A | | 10/1996 | Sluyterman et al. | |
| RE35,548 E | | 7/1997 | Sluyterman et al. | |
| 5,757,121 A | * | 5/1998 | Nakata | 313/440 |
| 5,777,429 A | * | 7/1998 | Headley | 313/440 |
| 5,905,331 A | * | 5/1999 | Misono | 313/413 |
| 6,005,340 A | * | 12/1999 | Misono et al. | 313/443 |

FOREIGN PATENT DOCUMENTS

| | | |
|---|---|---|
| EP | 1 094 490 | 4/2001 |
| GB | 1 591 392 | 8/1977 |
| JP | 55-33800 | 3/1980 |
| JP | 58-30046 | 2/1983 |
| JP | 62-86648 | 4/1987 |
| JP | 5-21016 | 1/1993 |
| JP | 5-94782 | 4/1993 |
| JP | 6-283115 | 10/1994 |
| JP | 3064317 | 5/2000 |
| JP | 2001-43815 | 2/2001 |
| JP | 3198106 | 6/2001 |
| JP | 2002-93354 | 3/2002 |

* cited by examiner

*Primary Examiner*—Nimeshkumar D. Patel
*Assistant Examiner*—Karabi Guharay

(57) ABSTRACT

A color picture tube device that can suppress the deformation of the electron beam spot shape and improve the horizontal resolution using a simple construction is provided. A horizontal deflection coil generates a horizontal deflection magnetic field that is substantially uniform. A plurality of electron beams are substantially parallel with the tube axis when passing one end of a core of a deflection yoke facing an electron gun. A lens forming unit forms a lens through which the plurality of electron beams pass, between the electron gun end of the core and a phosphor screen. The lens has an effect of causing the plurality of electron beams to approach each other in a horizontal direction, irrespective of which part of the phosphor screen the plurality of electron beams reach.

20 Claims, 13 Drawing Sheets

COLOR PICTURE TUBE DEVICE WITH IMPROVED HORIZONTAL RESOLUTION

This application is based on Japanese Patent Applications Nos. 2001-305531 and 2002-19683 with domestic priority claimed from the former application, the contents of which are hereby incorporated by reference.

BACKGROUND OF THE INVENTION

1. Field of the Invention

The present invention relates to a color picture tube device that deflects a plurality of electron beams which are emitted from an electron gun having a plurality of in-line cathodes, and displays a color image on a phosphor screen.

2. Related Art

In a color picture tube device having an in-line electron gun in which cathodes corresponding to the three colors of red (R), green (G), and blue (B) are horizontally aligned, three electron beams emitted from the electron gun need to meet in an appropriate point on a phosphor screen (this is called "convergence"). Self convergence and dynamic convergence are conventional techniques which are widely used for producing such convergence.

The self convergence technique produces convergence by generating non-uniform deflection magnetic fields for deflecting the electron beams. Typically, a horizontal deflection magnetic field and a vertical deflection magnetic field are distorted in the shapes of a pincushion and a barrel respectively. In this way, each of the three electron beams is deflected by a different amount while passing through the deflection magnetic fields, so that the three electron beams converge throughout the phosphor screen.

The dynamic convergence technique produces convergence by generating a magnetic field (a dynamic convergence magnetic field) for dynamically changing the angles of the two outer electron beams before the three electron beams are deflected. The intensity of this magnetic field is varied according to the amount of deflection, so that the three electron beams converge throughout the phosphor screen.

A self-convergent color picture tube device has a drawback that the spot shape of the three electron beams is deformed near the edges of the phosphor screen. Such a deformed spot shape causes a drop in resolution. Various techniques have been proposed to correct this (e.g. Published Unexamined Patent Application No. H09-102288). Nevertheless, these efforts cannot satisfactorily cope with the recent trends toward increasing display data density and widening deflection angle for shallow TV sets.

A dynamic-convergent color picture tube device uses uniform magnetic fields having no distortions as deflection magnetic fields, and so does not suffer from a drop in resolution. However, this type requires a complex construction.

SUMMARY OF THE INVENTION

The present invention aims to provide a color picture tube device that can suppress the deformation of the electron beam spot shape and improve the horizontal resolution, using a simple construction.

The stated object can be achieved by a color picture tube device that deflects a plurality of electron beams and produces a color image on a phosphor screen, including: an electron gun having a plurality of in-line cathodes, and emitting the plurality of electron beams; a deflection yoke including a horizontal deflection coil, a vertical deflection coil, and a core, the horizontal deflection coil generating a horizontal deflection magnetic field that is substantially uniform, and the vertical deflection coil generating a vertical deflection magnetic field; and a lens forming unit forming a lens which the plurality of electron beams pass through, the lens being positioned between an end of the core facing the electron gun and the phosphor screen, wherein the plurality of electron beams are substantially parallel with a tube axis of the color picture tube device, when passing the end of the core facing the electron gun, and the lens has (a) a horizontal converging effect of causing the plurality of electron beams to approach each other in a horizontal direction regardless of which part of the phosphor screen the plurality of electron beams reach, and (b) an intensity distribution such that the horizontal converging effect becomes weaker as the part of the phosphor screen which the plurality of electron beams reach is more distant in the horizontal direction from a vertical center line of the phosphor screen.

According to this construction, a substantially uniform magnetic field is used as the horizontal deflection magnetic field. As a result, the deformation of the electron beam spot shape caused by a distorted deflection magnetic field can be suppressed, with it being possible to improve the horizontal resolution. Also, by using the fact that the positions of the electron beams passing through the lens change as the electron beams are horizontally deflected, adjustments are made to the lens' intensity distribution in the horizontal direction so as to produce convergence over the entire area of the phosphor screen. This makes it basically unnecessary to use a horizontal deflection current of high frequency for adjusting the intensity of the magnetic field used for convergence. Hence the color picture tube device can be realized with a simple circuit construction.

It should be noted that the word "approach" used here includes not only the cases where the plurality of electron beams completely converge, but also the cases where the plurality of electron beams do not completely converge but come closer to each other, especially at the edges of the phosphor screen.

BRIEF DESCRIPTION OF THE DRAWINGS

These and other objects, advantages and features of the invention will become apparent from the following description thereof taken in conjunction with the accompanying drawings which illustrate specific embodiments of the invention.

In the drawings:

FIG. 8 shows the relationship between the deflection angle θ and the magnetic flux density By;

DESCRIPTION OF THE PREFERRED EMBODIMENT

The following describes an embodiment of a color picture tube device of the present invention, with reference to drawings.

(Overall Construction of a Color Picture Tube Device)

Figure 1:
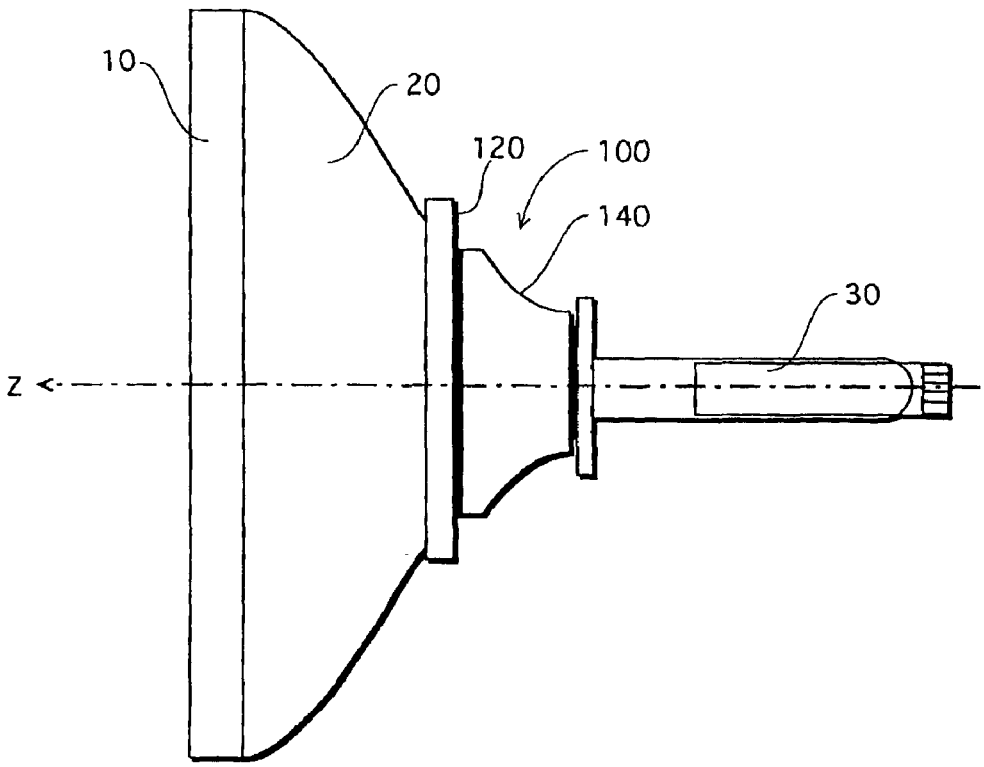
FIG. 1 is a side view of a color picture tube device to which an embodiment of the invention relates.

FIG. 1 is a side view of a color picture tube device to which the embodiment of the present invention relates.

The color picture tube device is roughly made up of an envelope including a panel 10 and a funnel 20, an in-line electron gun 30, and a deflection yoke 100. A phosphor screen is formed on the internal face of the panel 10. The in-line electron gun 30 is provided in a neck of the funnel 20, and emits three electron beams toward the phosphor screen. The deflection yoke 100 is installed around the funnel 20. In this embodiment, an electron gun that emits three horizontally-aligned electron beams in substantially parallel with each other along the tube axis is used as the electron gun 30, so that the three electron beams enters a horizontal deflection magnetic field in substantially parallel with each other. While this embodiment describes the case where the three electron beams are aligned in the order of B, G, and R from left to right as seen from the phosphor screen side, the invention is not limited to such an order.

Figure 2:
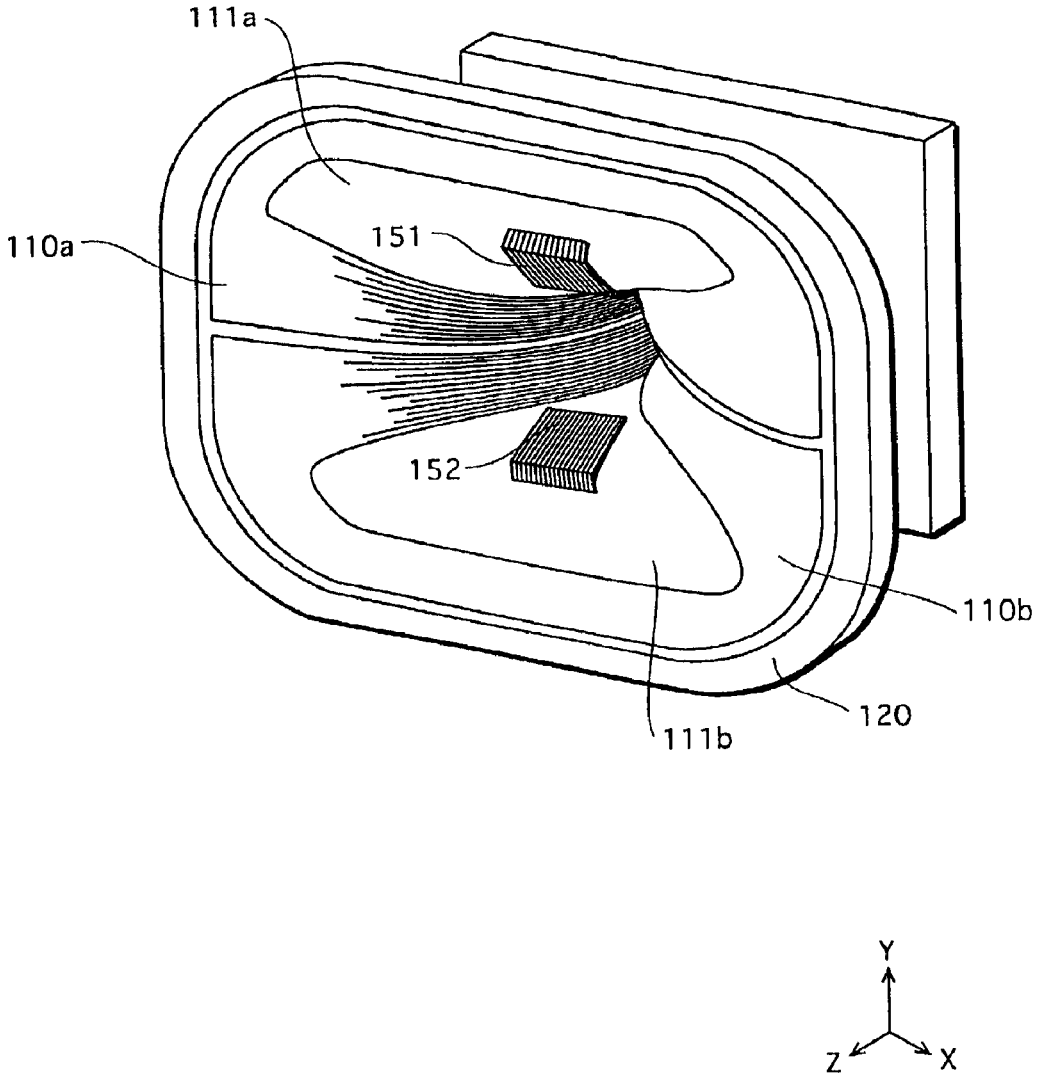
FIG. 2 is a perspective view showing an example construction of a deflection yoke in the embodiment.
Figure 3:
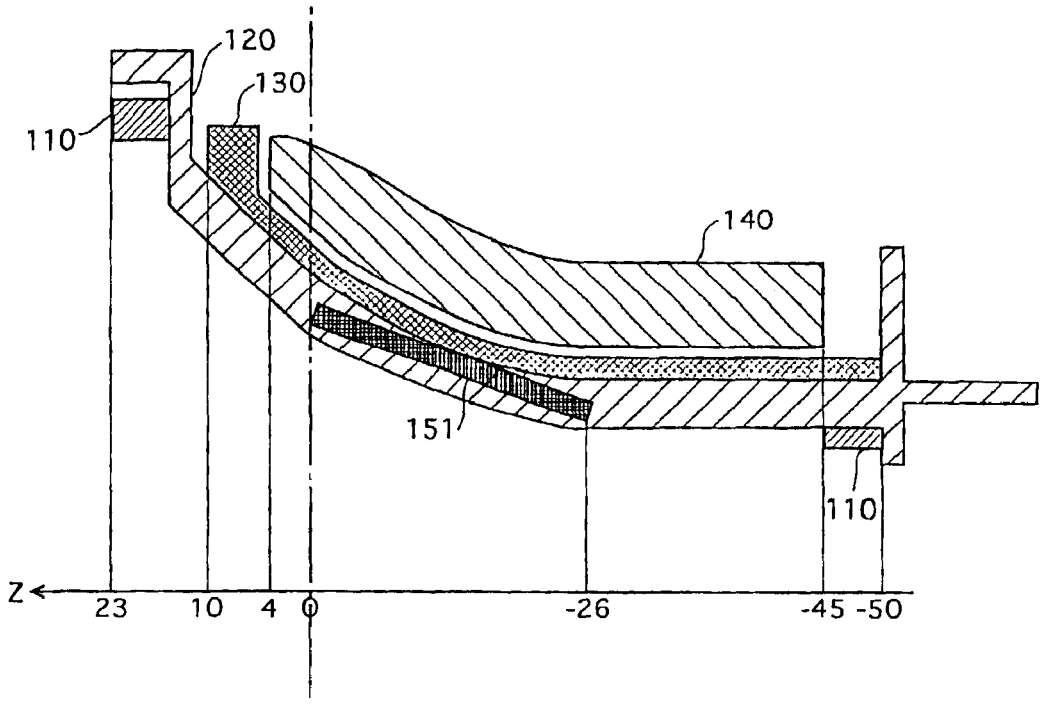
FIG. 3 is a cross section of the upper half of the deflection yoke, cut by a plane that is perpendicular to a horizontal direction (the direction of the X axis) and contains a tube axis.

The deflection yoke 100 forms deflection magnetic fields in the funnel 20, to deflect the electron beams emitted from the electron gun 30. FIG. 2 is a perspective view showing an example construction of the deflection yoke 100. FIG. 3 is a cross section of the upper half of the deflection yoke 100, cut by a plane that is perpendicular to a horizontal direction (the direction of the X axis) and contains the tube axis (the Z axis). The deflection yoke 100 includes a horizontal deflection coil 110, an insulating frame 120, a vertical deflection coil 130, and a ferrite core 140 which are provided in this order in an outward direction (from the inside of the funnel 20 toward the outside).

The horizontal deflection coil 110 is made up of one pair of horizontal coils 110*a* and 110*b* which are each formed by winding a conductor in the shape of a saddle. The horizontal coils 110*a* and 110*b* are set so that their respective windows 111*a* and 111*b* provided in the middle face each other, and positioned along the internal face of the insulating frame 120 so as to be in intimate contact with the insulating frame 120. Likewise, the vertical deflection coil 130 is made up of one pair of vertical coils which are each formed by winding a conductor in the shape of a saddle. The ferrite core 140 is provided so as to surround these vertical coils. The ferrite core 140 serves as a magnetic core or the like, for each of the deflection magnetic fields generated by the horizontal deflection coil 110 and vertical deflection coil 130.

In this embodiment, a coil for forming a lens (a magnetic lens by a quadrupole magnetic field) is provided in each of the windows 111*a* and 111*b*. Hereinafter, the coil provided in the window 111*a* is referred to as an upper coil 151, and the coil provided in the window 111*b* as a lower coil 152. The upper coil 151 and the lower coil 152 are also collectively called a quadrupole coil 150. The upper coil 151 and the lower coil 152 form a magnetic lens, which serves to converge the three electron beams in the horizontal direction on the phosphor screen disposed on the internal face of the panel 10. The function of the quadrupole coil 150 is explained in detail later.

The position of each member of the deflection yoke 100 is explained by referring to FIG. 3. In the drawing, the position of the phosphor screen end of the quadrupole coil 150 (the upper coil 151 in FIG. 3) is set as a reference point (Z=0) on the tube axis (the Z axis), with the positive direction being on the phosphor screen side and the negative direction being on the electron gun side. This being so, the horizontal deflection coil 110 is located from −50 to 23 (in mm), the vertical deflection coil 130 is located from −50 to 10, and the ferrite core 140 is located from −45 to 4. Meanwhile, the core of the quadrupole coil 150 is located from −26 to 0. Note here that the core of the quadrupole coil 150 has a width of 15 mm, and is embedded in the insulating frame 120 in the window 111*a* (111*b*)) (though the upper coil 151 and the lower coil 152 are shown to appear in FIG. 2 for convenience in explanation).

A horizontal sawtooth deflection current corresponding to a horizontal deflection frequency is supplied to the horizontal deflection coil 110. As a result, the horizontal deflection coil 110 generates a magnetic field in the vertical direction in the funnel 20, and deflects the electron beams in the horizontal direction. Meanwhile, a vertical sawtooth deflection current corresponding to a vertical deflection frequency is supplied to the vertical deflection coil 130. As a result, the vertical deflection coil 130 generates a magnetic field in the horizontal direction in the funnel 20, and deflects the electron beams in the vertical direction.

In this embodiment, the horizontal deflection magnetic field generated by the horizontal deflection coil 110 is a substantially uniform magnetic field. In this way, the deformation of the electron beam spot shape near the horizontal edges of the phosphor screen can be prevented. The following is an explanation of the notion of a substantially uniform magnetic field referred to in this embodiment.

The horizontal deflection magnetic field which is substantially uniform is the following.

Suppose the Z axis is the tube axis, the direction of the X axis is the horizontal direction of the phosphor screen, and the direction of the Y axis is the vertical direction of the phosphor screen, with the X coordinate and the Y coordinate on the Z axis both being 0. Let Bh(x,z) be the magnetic flux density of the Y axial direction component of the horizontal deflection magnetic field. Then Bh(x,z) can be expressed by Formula 1:

$$Bh(x,z)=Bh_0(z)+Bh_2(z)\cdot x^2 \quad \text{(Formula 1)}$$

where x is a variable showing the displacement in the direction of the X axis from the Z axis, and z is a variable showing the Z coordinate.

In Formula 1, $Bh_0(z)$ is the magnetic flux density of the Y axial direction component of the horizontal deflection magnetic field on the Z axis, and is a function of z. $Bh_2(z)$ is called a quadratic distortion coefficient, and is a function of z, too. $Bh_2(z)$ serves as the coefficient of $x^2$. If $Bh_2(z)=0$ regardless of the value of z, Bh(x,z) is determined by the value of z regardless of the value of x. When this is the case, the horizontal deflection magnetic field is a completely uniform magnetic field.

However, it is not easy to realize such a completely uniform magnetic field by coil design. Even if an attempt is made to realize a completely uniform magnetic field, in actuality $Bh_2(z)$ will end up having some component albeit only slightly. In this embodiment, therefore, if the horizontal deflection magnetic field satisfies Formula 2 at least in a range of 75% of the length of the horizontal deflection coil 110 in the direction of the Z axis, the horizontal deflection magnetic field is regarded as a substantially uniform magnetic field. Here, the maximum value of the magnetic flux density distribution $Bh_0(z)$ on the Z axis is normalized as 1, and x is expressed in mm.

$$-1\times10^{-4} \leqq Bh_2(z) \leqq 1\times10^{-4}\ (\mathrm{l/mm^2}) \qquad \text{(Formula 2)}$$

On the other hand, the vertical deflection magnetic field needs to be adjusted according to the vertical effect of the lens which horizontally converges the three electron beams on the phosphor screen, namely, the lens' effect of moving the electron beams in the vertical direction.

If the lens has no vertical effect, it is desirable to design the vertical deflection magnetic field of the vertical deflection coil 130 as a substantially uniform magnetic field, in order to produce convergence when the electron beams are vertically deflected. Suppose the Z axis is the tube axis, the direction of the X axis is the horizontal direction of the phosphor screen, and the direction of the Y axis is the vertical direction of the phosphor screen, with the X coordinate and the Y coordinate on the Z axis both being 0. Let Bv(y,z) be the magnetic flux density of the X axial direction component of the vertical deflection magnetic field. Then Bv(y,z) can be expressed by Formula 3:

$$Bv(y,z)=Bv_0(z)+Bv_2(z)\cdot y^2 \qquad \text{(Formula 3)}$$

where y is a variable showing the displacement in the direction of the Y axis from the Z axis, and z is a variable showing the Z coordinate.

In Formula 3, $Bv_0(z)$ is the magnetic flux density of the X axial direction component of the vertical deflection magnetic field on the Z axis, and is a function of z. $Bv_2(z)$ is called a quadratic distortion coefficient, and is a function of z, too. $Bv_2(z)$ serves as the coefficient of $y^2$. If $Bv_2(z)=0$ regardless of the value of z, Bv(y,z) is determined by the value of z regardless of the value of y. When this is the case, the vertical deflection magnetic field is a completely uniform magnetic field.

However, even when an attempt is made to realize such a completely uniform magnetic field, in actuality $Bv_2(z)$ will end up having some component albeit only slightly, as in the case of the horizontal deflection magnetic field. In view of this, if the vertical deflection magnetic field satisfies Formula 4 at least in a range of 75% of the length of the vertical deflection coil 130 in the direction of the Z axis, the vertical deflection magnetic field is regarded as a substantially uniform magnetic field. Here, the maximum value of the magnetic flux density distribution $Bv_0(z)$ on the Z axis is normalized as 1, and y is expressed in mm.

$$-1\times10^{-4} \leqq Bv_2(z) \leqq 1\times10^{-4}\ (\mathrm{l/mm^2}) \qquad \text{(Formula 4)}$$

If the lens has a vertical diverging effect, that is, an effect of moving the electron beams apart from the center in the vertical direction, the amount of vertical movement differs for each electron beam. Accordingly, it is desirable to design the vertical deflection magnetic field of the vertical deflection coil 130 as a barrel magnetic field, to cancel out this vertical diverging effect. In so doing, convergence can be produced when the electron beams are vertically deflected. In Formula 3, if the vertical deflection magnetic field satisfies Formula 5, it is regarded as a barrel magnetic field:

$$Bv_2(z)<-1\times10^{-4}\ (\mathrm{l/mm^2}) \qquad \text{(Formula 5)}$$

On the other hand, if the lens has a vertical converging effect, that is, an effect of moving the electron beams toward the center in the vertical direction, the amount of vertical movement differs for each electron beam. Accordingly, it is desirable to design the vertical deflection magnetic field of the vertical deflection coil 130 as a pincushion magnetic field, to cancel out this vertical converging effect. In so doing, convergence can be produced when the electron beams are vertically deflected. In Formula 3, if the vertical deflection magnetic field satisfies Formula 6, it is regarded as a pincushion magnetic field:

$$Bv_2(z)>1\times10^{-4}\ (\mathrm{l/mm^2}) \qquad \text{(Formula 6)}$$

In this embodiment, the quadrupole coil 150 forms the quadrupole magnetic lens. Such a lens has a horizontal converging effect and a vertical diverging effect. Accordingly, the vertical deflection magnetic field is designed as a barrel magnetic field. The quadratic distortion coefficient $Bv_2(z)$ is largest around the peak of the magnetic field, with its largest absolute value being set at $Bv_2(z)=-16\times10^{-4}$ ($\mathrm{l/mm^2}$).

Figure 4:
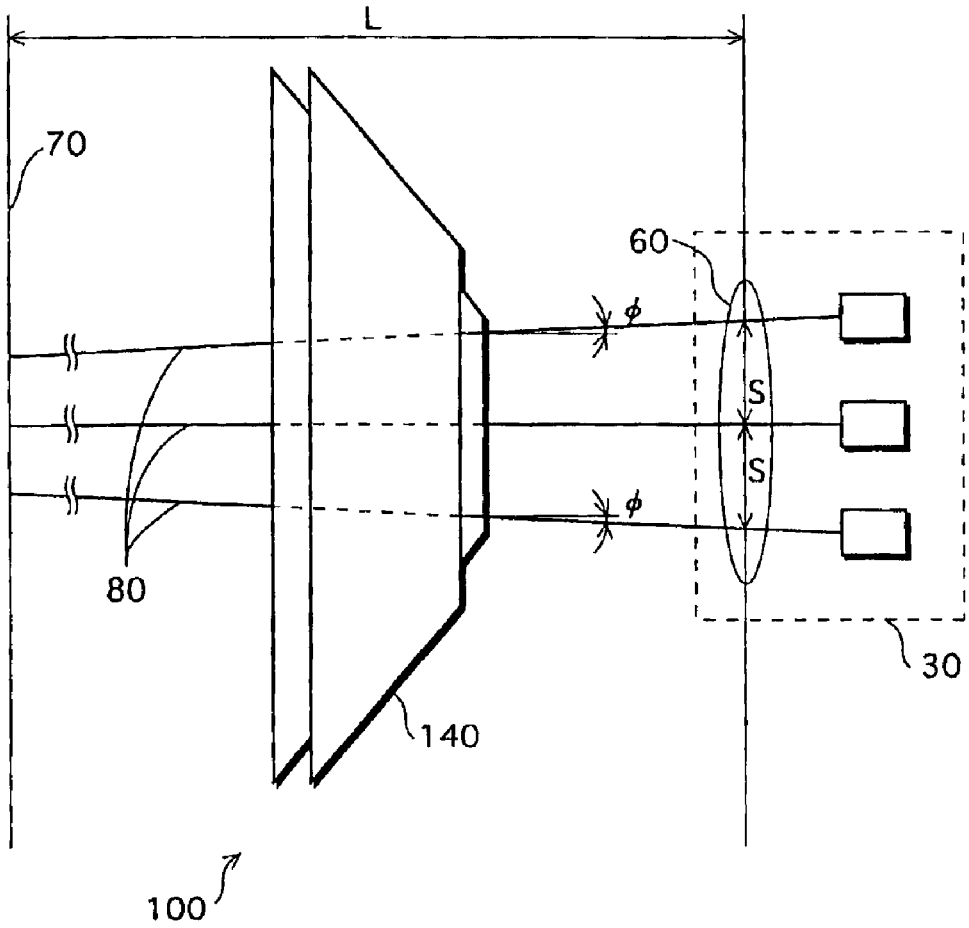
FIG. 4 is a representation of the paths of three horizontally-aligned electron beams, looked at in a vertical direction.

Also, the three electron beams are in substantially parallel with each other when entering the electron gun end of the ferrite core 140 in the deflection yoke 100. Substantial parallelity referred to here can be defined as follows. FIG. 4 is a representation of the paths of the three horizontally-aligned electron beams, as seen in the vertical direction. Here, the quadrupole magnetic lens is not present. In the drawing, S denotes the horizontal interval of adjacent electron beams 80 on a main lens 60 of the electron gun 30. L denotes the distance from the main lens 60 to the phosphor screen 70 in the direction of the tube axis. $\phi$ denotes the angle which each outer electron beam forms with an axis parallel to the central electron beam (or the tube axis) at the electron gun end of the ferrite core 140. This being so, if the three electron beams satisfy Formula 7, they are regarded as being in substantially parallel with each other:

$$|\phi|<(1/2)\cdot\tan^{-1}(S/L) \qquad \text{(Formula 7)}$$

Suppose the phosphor screen measures 86 cm from the upper left corner to the lower right corner, and the maximum deflection angle is 100° (approximately S=6 mm and L=450 mm). If $|\phi|<0.38°$, the electron beams are substantially parallel with each other. Actual design can be performed in the following manner. First $|\phi|=0°$ is set, and then other design parameters are set. If a deviation occurs, fine adjustments are made so as to eventually satisfy $|\phi|<0.38°$.

Thus, the horizontal deflection magnetic field is designed as a substantially uniform magnetic field, and the three electron beams entering the deflection magnetic field region are arranged in substantially parallel with each other. As a result, the three electron beams arriving at the phosphor screen do not have mutual deviations in the vertical direction, though they have mutual deviations in the horizontal direction. Therefore, if the horizontal deviations are adjusted, the three electron beams can be brought into convergence. In this embodiment, the quadrupole magnetic lens formed by the quadrupole coil 150 is employed to converge the three electron beams in the horizontal direction. Though such a lens has a vertical diverging effect, this can be canceled out by forming the vertical deflection magnetic field as a barrel magnetic field, as described earlier.

Figure 5:
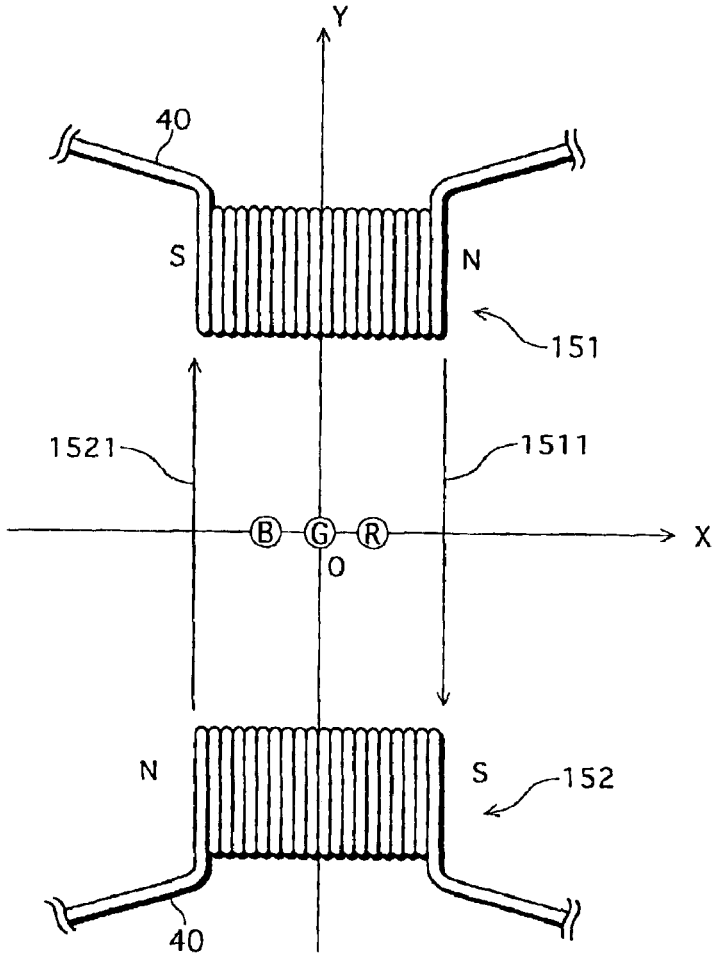
FIG. 5 is a representation of a construction and effect of a magnetic lens formed by a quadrupole coil shown in FIG. 2.

The effect of the quadrupole magnetic lens formed by the quadrupole coil 150 is explained in detail below. FIG. 5 shows the upper coil 151, the lower coil 152, and the three electron beams (R, G, B) passing therebetween, as seen from the phosphor screen side. In this embodiment, the upper coil 151 and the lower coil 152 are each formed by winding a conductor 40 on a core piece made of a Ni ferrite. A steady-state current is supplied to this conductor 40. Though the upper coil 151 and the lower coil 152 each consist of 100 turns in this embodiment, the number of turns of each coil can be adjusted arbitrarily.

With this construction, the upper coil 151 and the lower coil 152 function as magnet coils to form magnetic poles on both ends. As a result, a quadrupole magnetic field is generated as shown in FIG. 5. It should be noted here that only the vertical components of the quadrupole magnetic field are shown in FIG. 5. In more detail, a magnetic field 1511 has a vertical component from the north pole of the upper coil 151 to the south pole of the lower coil 152. A magnetic field 1521 has a vertical component from the north pole of the lower coil 152 to the south pole of the upper coil 151. The magnetic fields 1511 and 1521 exert a force in the horizontal direction on the electron beams.

Figure 6:
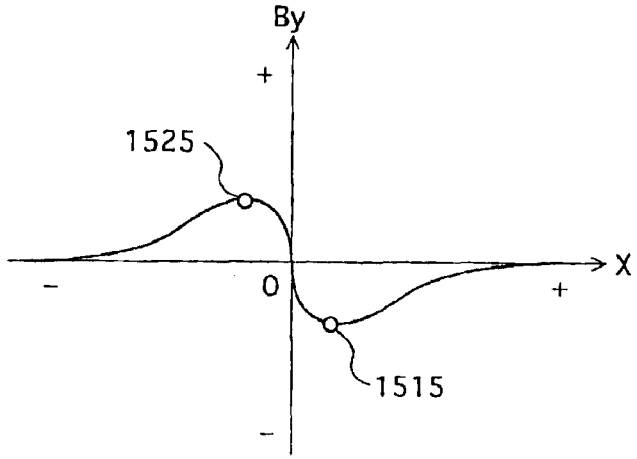
FIG. 6 shows an example of magnetic flux density distribution of the quadrupole magnetic field shown in FIG. 5, when no vertical deflection is performed.

The vertical component of this quadrupole magnetic field has a magnetic flux density distribution shown in FIG. 6, with reference to the position in the horizontal direction. Here, By denotes the magnetic flux density of the vertical component of the quadrupole magnetic field, and X denotes the displacement in the horizontal direction from the tube axis. Peaks 1515 and 1525 of the absolute value of the magnetic flux density occur in the vicinity of the magnetic poles of the magnetic fields 1511 and 1521. The three electron beams are always between these two peaks 1515 and 1525. The positions of the three electron beams between the two peaks 1515 and 1525 change as the electron beams are horizontally deflected.

In this embodiment, the three electron beams are in substantially parallel with each other when entering the deflection magnetic field region. This being so, if the three electron beams are not horizontally deflected by the horizontal deflection magnetic field, the three electron beams can be easily converged at the center of the phosphor screen by bending the two outer electron beams toward each other using the horizontal converging effect of the quadrupole magnetic field. However, if the three electron beams are horizontally deflected, the provision of the quadrupole magnetic field alone is not enough to converge the three electron beams in the horizontal direction anywhere on the phosphor screen.

The following explains the principle of designing the quadrupole magnetic field for converging the three electron beams throughout the phosphor screen in this embodiment.

The distance between the horizontal converging lens formed by the quadrupole magnetic field and the part of the phosphor screen which the electron beams reach (assuming that the horizontal converging lens is located at the deflection center) increases as the electron beams are more deflected in the horizontal direction (i.e. as the deflection angle θ increases). This tendency is more noticeable when the phosphor screen is more flat. Accordingly, as the deflection angle θ increases, the converging power F of the horizontal converging lens for bending the two outer electron beams toward each other needs to be weakened. In view of this, the following examines a necessary condition for producing convergence, in an assumption that the electron beams are not vertically deflected.

Suppose the converging power F is unchanged even when the three electron beams are horizontally deflected. This being so, the point where the three electron beams meet each other lies approximately in a circular orbit. Let $\theta_0$ be the deflection angle of the central electron beam, Lm be the distance between the point where the central electron beam passes through the deflection center and the point where the three electron beams meet each other, and $L_0$ be the distance between the point where the central electron beam passes through the deflection center and the point where the three electron beams meet each other when no horizontal deflection is performed. Then the following approximate relationship exists between Lm and $L_0$:

$$Lm \approx L_0 \cdot \cos\theta_0 \qquad \text{(Formula 8)}$$

In the case where the three electron beams meet each other on the phosphor screen, on the other hand, the distance Lm' between the point where the central electron beam passes through the deflection center and the point where the three electron beams meet each other has the following approximate relationship with the distance $L_0$:

$$Lm' \approx L_0/\cos\theta_0 \qquad \text{(Formula 9)}$$

In this embodiment, the horizontal deflection magnetic field is a substantially uniform magnetic field, and the three electron beams entering the horizontal deflection magnetic field are in substantially parallel with each other. These factors indicate that the deflection angle of the central electron beam and the deflection angle of each of the two outer electron beams are approximately equal. Accordingly, the deflection angle of each electron beam can be denoted by θ. This being so, how much the converging power F should be weakened can be determined using the ratio between Lm and Lm'. Which is to say, the converging power F needs to have the following approximate relationship with the deflection angle θ:

$$F = Lm/Lm' = \cos^2\theta \qquad \text{(Formula 10)}$$

Figure 7:
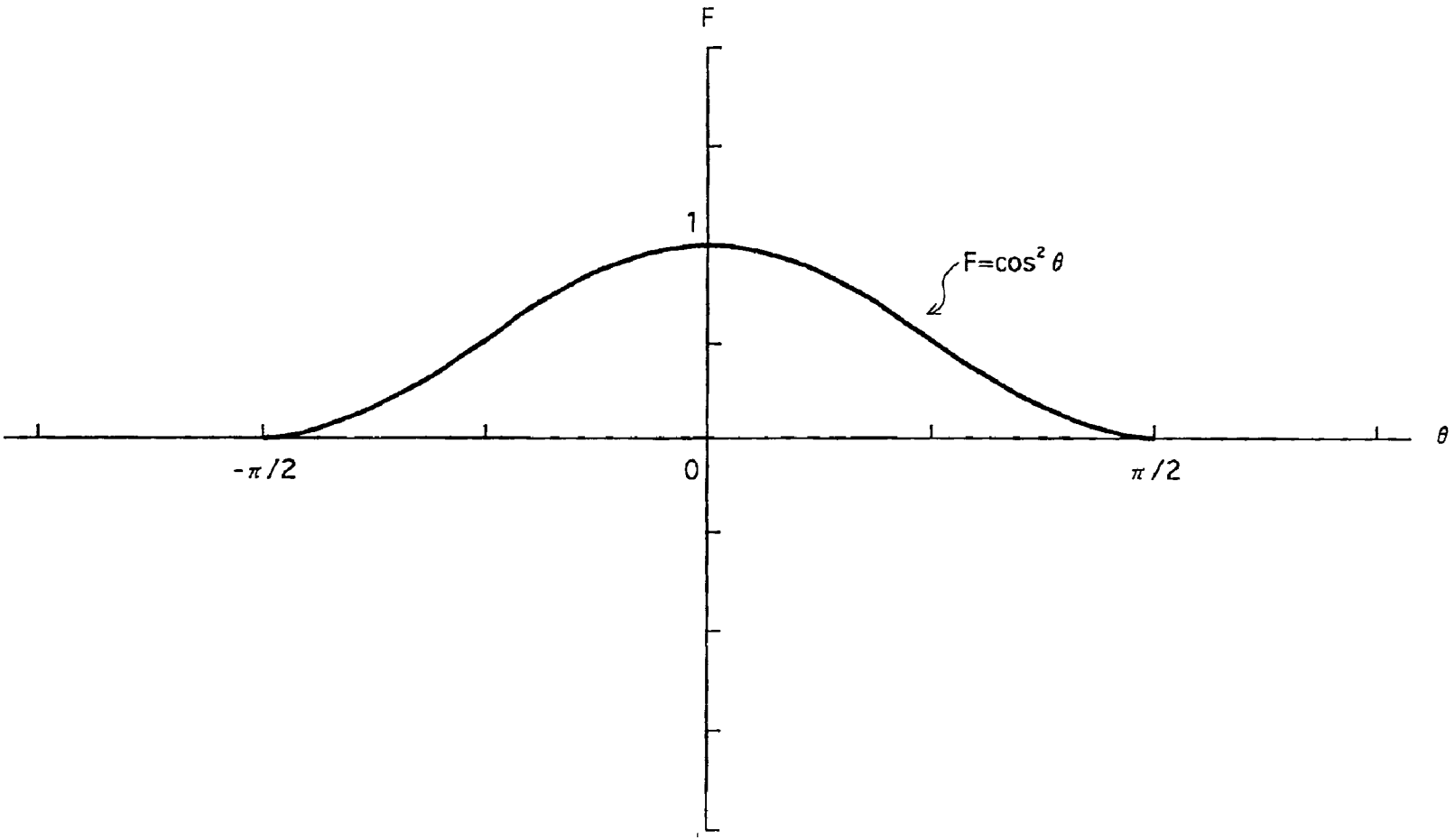
FIG. 7 shows the relationship between the deflection angle θ and the converging power F.

Here, the deflection angle is set as 0 when the electron beams are not horizontally deflected, +θ when the electron beams are deflected in the positive direction of the horizontal axis (the X axis), and −θ when the electron beams are deflected in the negative direction of the horizontal axis. Formula 10 can be represented by a graph as shown in FIG. 7.

To change the converging power F according to the deflection angle θ in this way, the magnetic flux density By of the quadrupole magnetic field on the X axis needs to have the following relationship with the deflection angle θ. This is obtained from the result of integrating Formula 10.

$$By = B_0\{\theta + (1/2)\cdot\sin 2\theta\} \qquad \text{(Formula 11)}$$

Here, $B_0$ is a proportionality constant. If the positive direction of the X axis is as shown in FIGS. 2 and 6, $B_0<0$. This being the case, Formula 11 can be represented by a graph shown in FIG. 8. In the drawing, the horizontal axis shows the deflection angle θ. However, if the quadrupole magnetic lens is positioned in the vicinity of the deflection center, a similar distribution applies even when the horizontal axis shows X. Accordingly, by passing the three electron beams between the two peaks 1515 and 1525 of the magnetic flux density in the distribution exemplified in FIG. 6, the three electron beams can be properly converged even when they are horizontally deflected.

Figure 9:
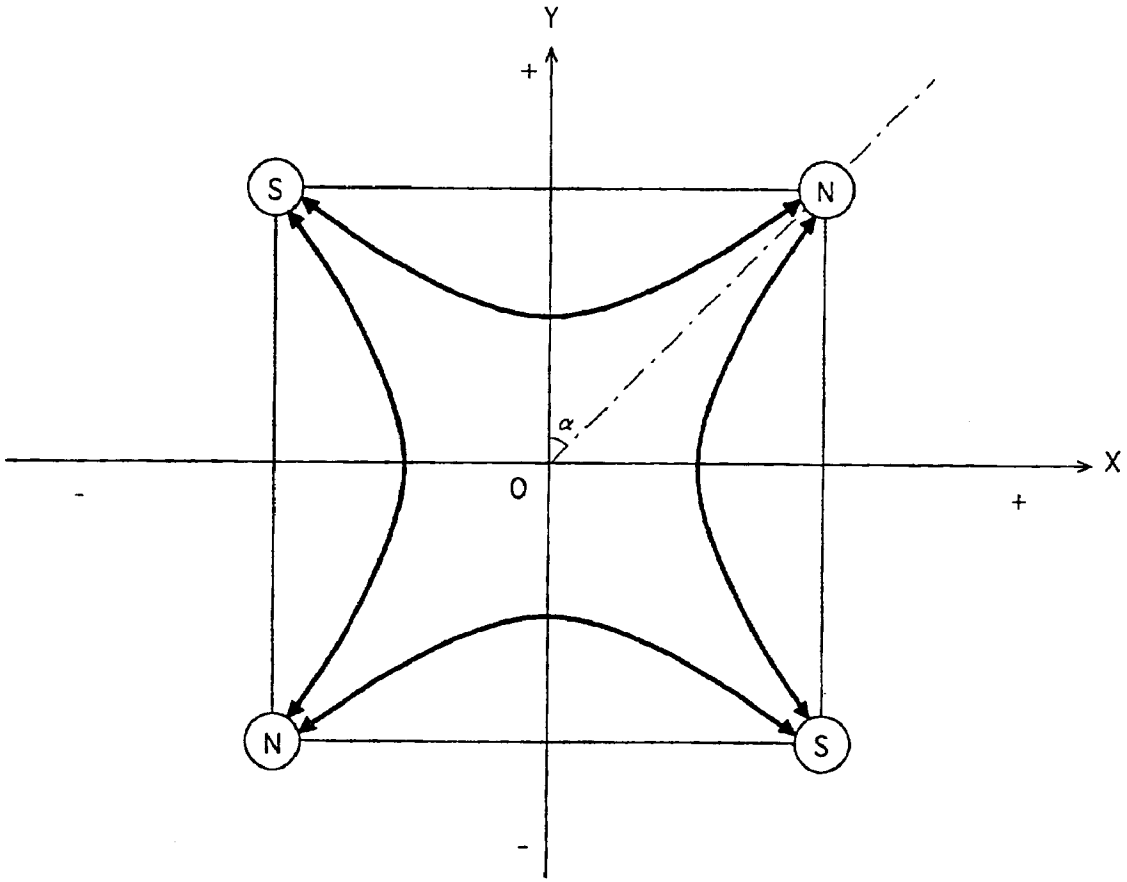
FIG. 9 is a representation of a quadrupole magnetic field where the angle α of each magnetic pole (north pole and south pole) with respect to the Y axis is approximately 45°.
Figure 10:
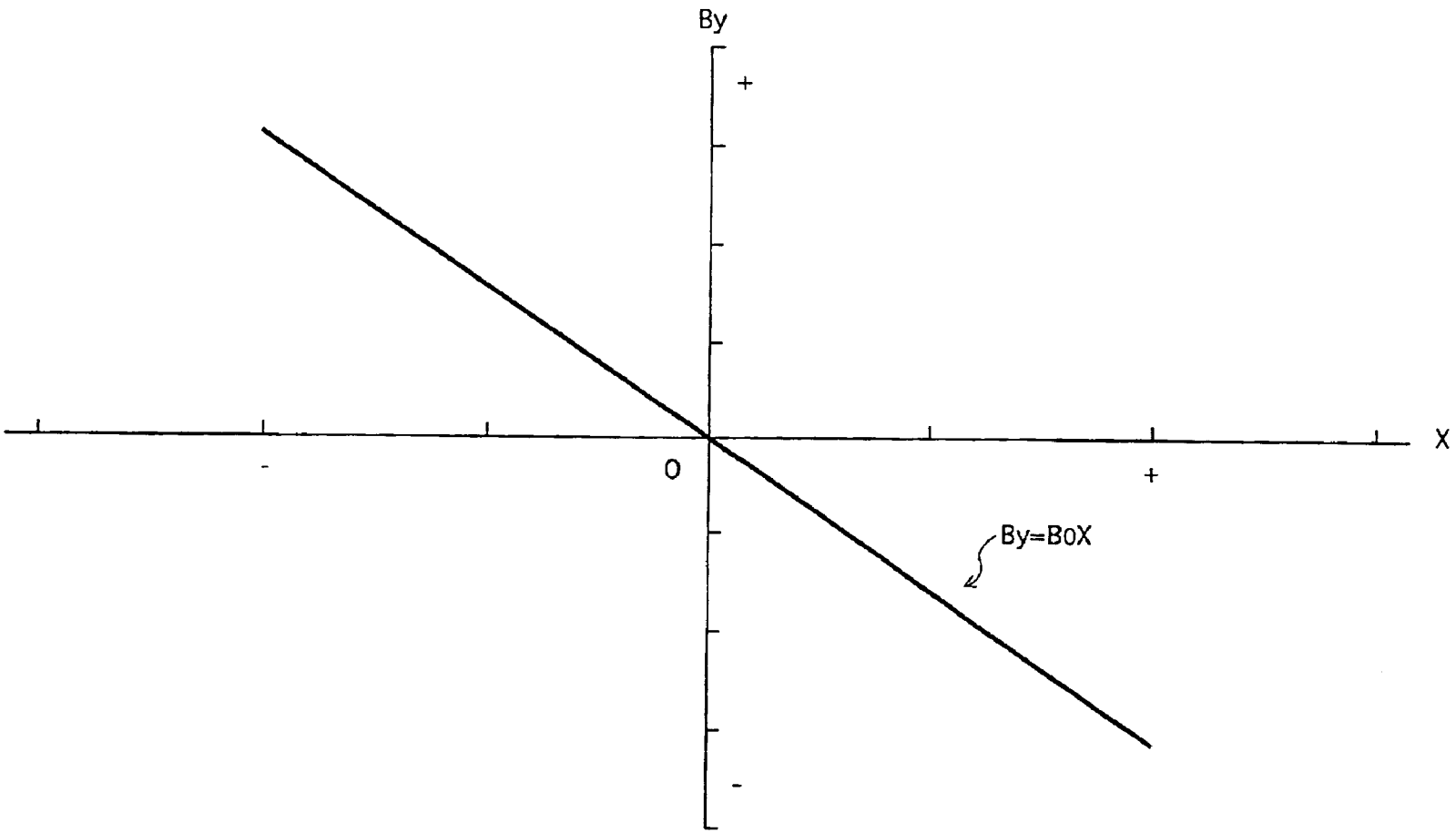
FIG. 10 shows a magnetic flux density distribution of the quadrupole magnetic field shown in FIG. 9 on the X axis.

FIG. 9 shows a typical quadrupole magnetic field where the angle $\alpha$ of each magnetic pole (north pole and south pole) with respect to the Y axis is about 45°. The magnetic flux density distribution of such a quadrupole magnetic field on the X axis can be represented by a straight line shown in FIG. 10. In this embodiment, the horizontal deflection magnetic field is a substantially uniform magnetic field, and the three electron beams are substantially parallel with each other when entering the horizontal deflection magnetic field. This being so, it is difficult to properly converge the three electron beams when they are horizontally deflected, if the quadrupole magnetic field like the one in FIG. 9 is used.

Figure 11:
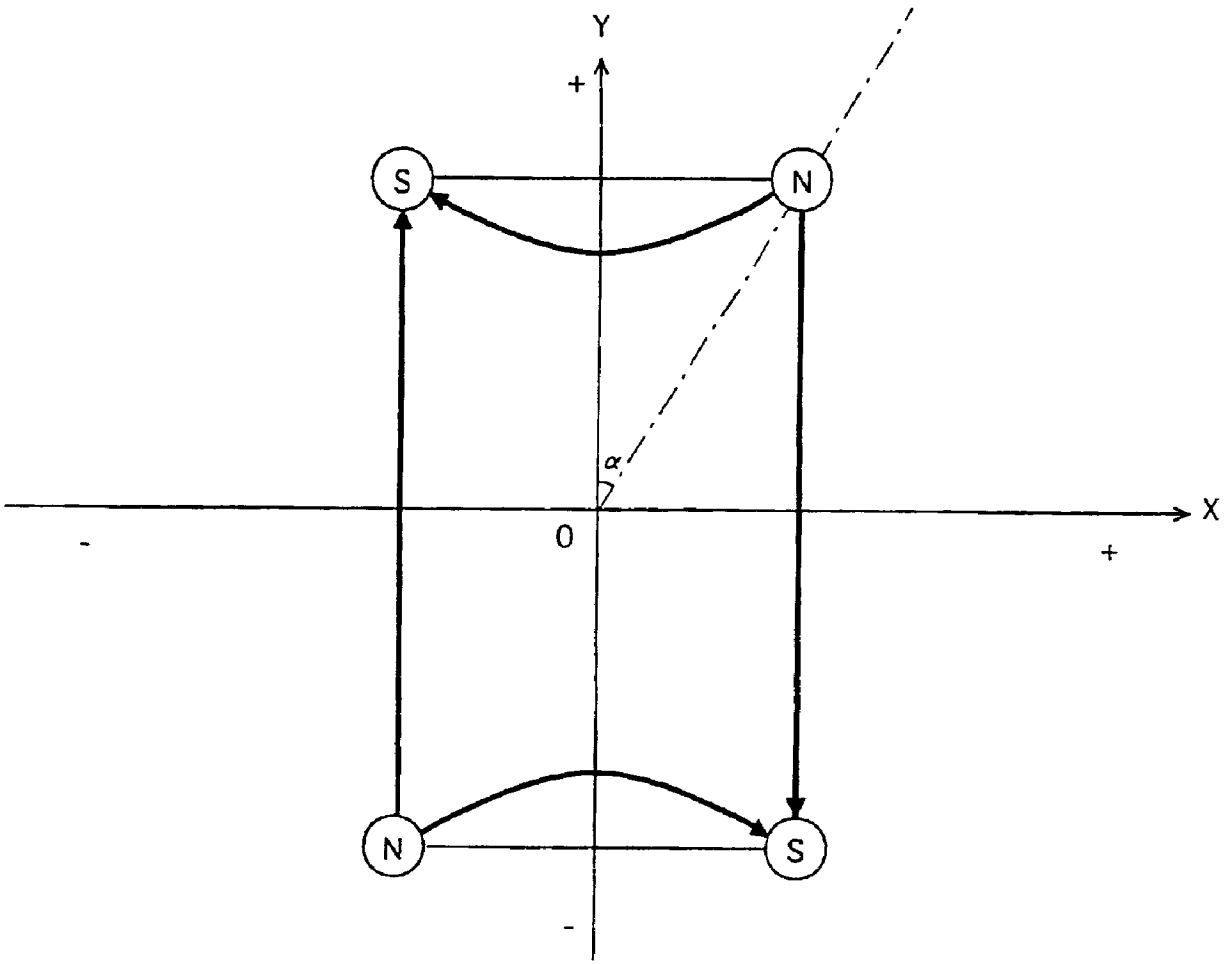
FIG. 11 illustrates how the angle α of each magnetic pole should be set in the quadrupole magnetic field of the embodiment.

On the other hand, the quadrupole magnetic field of this embodiment has the following construction. First, the angle $\alpha$ of each magnetic pole (see FIG. 11) is set in the following range:

$$10° < \alpha < 35° \quad \text{(Formula 12)}$$

Figure 8:
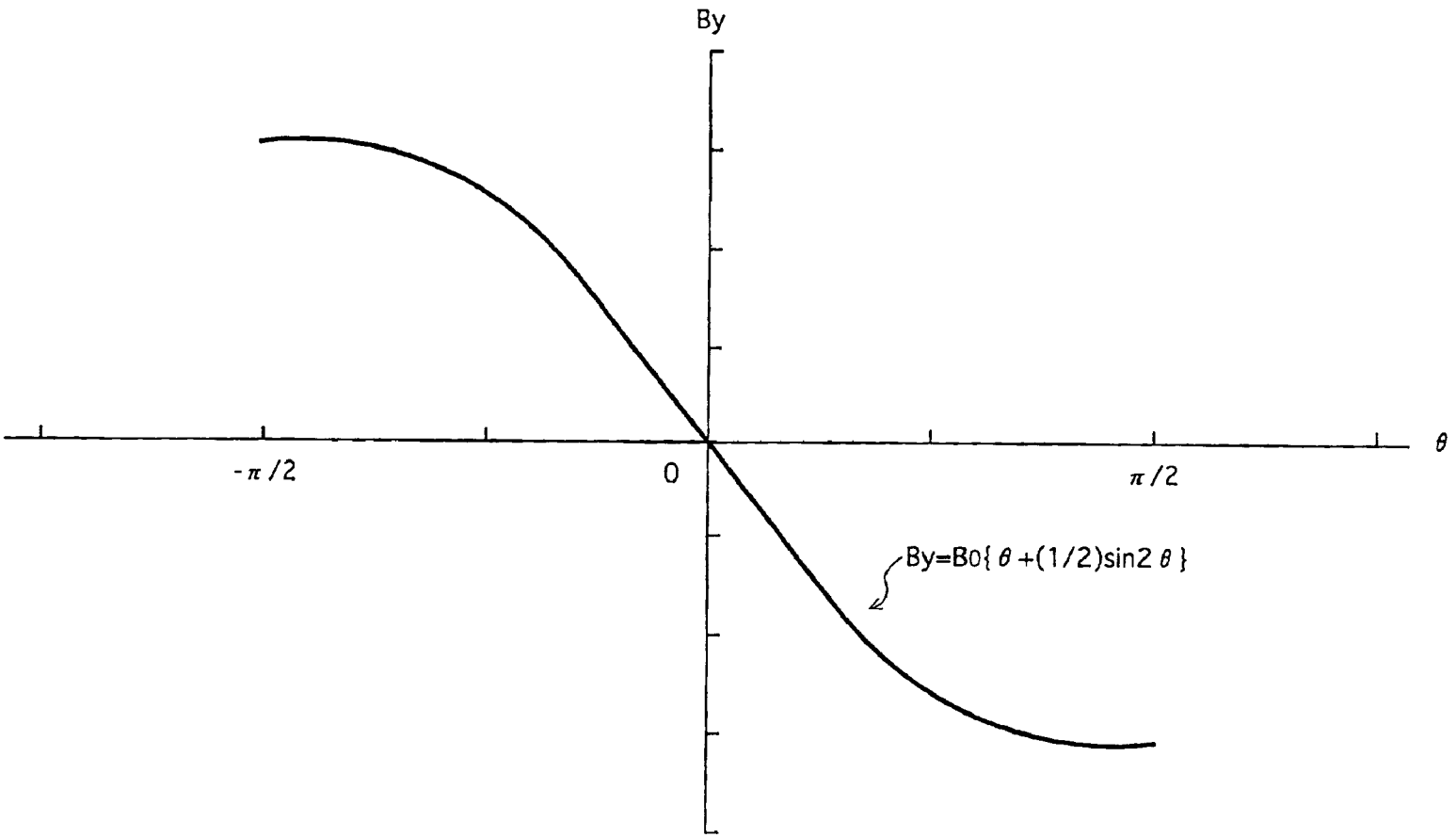
Figure 12:
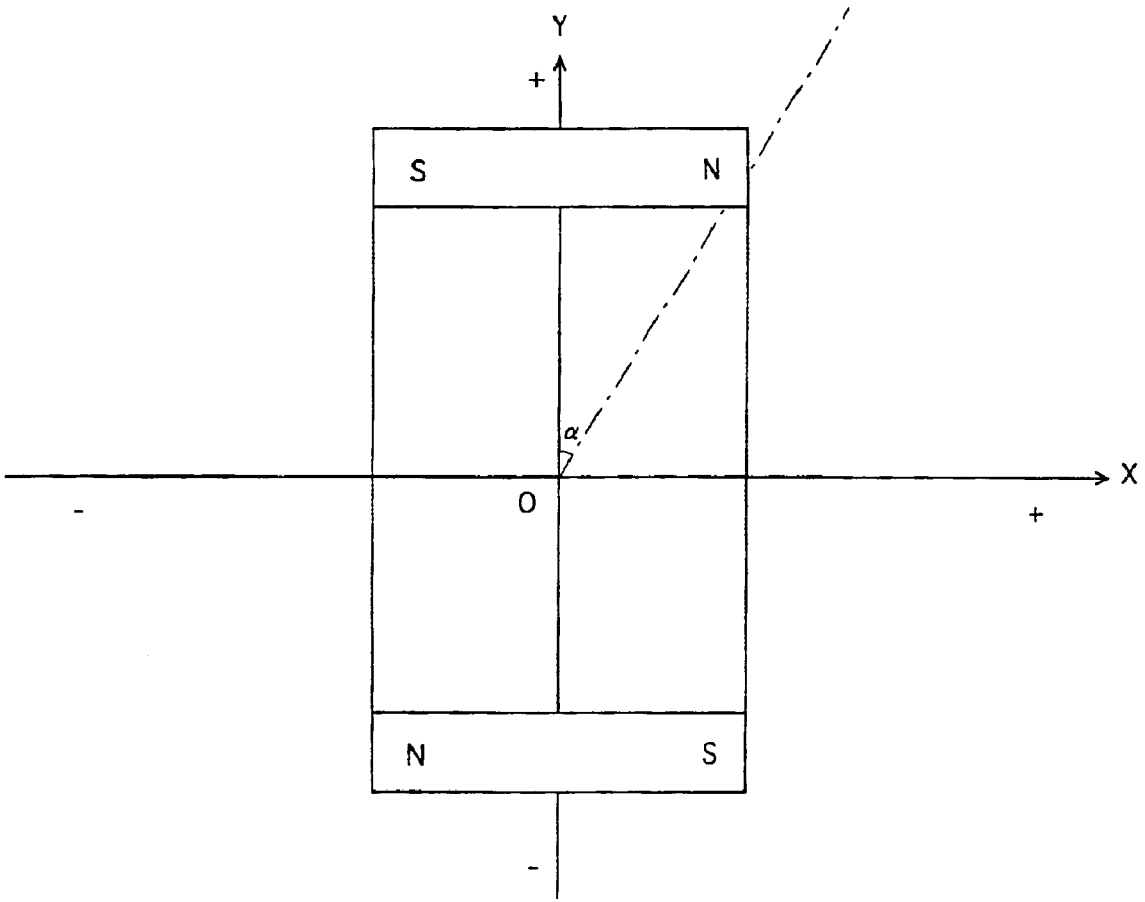
FIG. 12 is a representation of the placement of magnets and the like in the embodiment.

By doing so, the magnetic flux density distribution is distorted in the shape of a letter S, like those shown in FIGS. 6 and 8. To further approximate the magnetic flux density distribution to those of FIGS. 6 and 8, it is preferable to use rodlike magnets or coils wound on rodlike cores and install them so that magnetic fluxes near the magnetic poles flow in the horizontal direction (see FIG. 12). Other methods of adjusting the orientations of the magnetic fluxes can also be used instead of the rodlike shape.

It is also possible to form the quadrupole magnetic field by winding a coil on the ferrite core 140 of the deflection yoke 100 in a toroidal shape. In this case too, the flowing out of the magnetic flux at each magnetic pole can be controlled by setting the angle of the magnetic pole and adjusting the core shape, the ratio of turns, the ratio of current amounts, and the like. Thus, the same effects can still be achieved in cases other than using the coils described in this embodiment.

The above describes the principle of designing the quadrupole magnetic field. In actual design, it is preferable to make more detailed optimizations. Also, the above example uses the approximation of Formula 8. However, if the horizontal deflection magnetic field has a length in the direction of the Z axis as in this embodiment, an approximation such as Formula 8' can be equally used. Thus, the converging power F is not limited to the above.

$$Lm \approx L_0 \cdot \cos^2 \theta_0 \quad \text{(Formula 8')}$$

When the approximation of Formula 8' is used, the converging power F and the magnetic flux density distribution By are respectively expressed by Formulas 10' and 11':

$$F = Lm/Lm' = \cos^3 \theta \quad \text{(Formula 10')}$$

$$By = B_0'\{(3/4)\cdot \sin \theta + (1/12)\cdot \sin 3\theta\} \quad \text{(Formula 11')}$$

Though not illustrated, their graph representations are similar to those of Formulas 10 and 11. Hence convergence can be produced in this case too. Also, even if the quadrupole magnetic field and the deflection center are positioned at different places, this can be dealt with by the following relationship as one example. Let d be the distance between the quadrupole magnetic field and the deflection center, and $\theta$ be the deflection angle. Then the amount of movement in the quadrupole magnetic field caused by the deflection by the angle $\theta$ is $d \cdot \tan \theta$.

The magnetic flux density distribution (see FIG. 6) described above has the following effects. In the horizontal center of the phosphor screen where the three electron beams are not horizontally deflected (i.e. when the central electron beam (G) is at the center of the X axis as shown in FIG. 5), the central electron beam corresponds to X=0 in FIG. 6 and so is not affected by the quadrupole magnetic field. Meanwhile, the two outer electron beams (B and R) are acted upon by a force of moving toward the central electron beam by the vertical components of the quadrupole magnetic field that have opposite directions and similar intensities. As a result of this horizontal converging effect, the three electron beams are converged. Such a horizontal converging effect is exerted by the magnetic lens formed by the quadrupole magnetic field.

On the other hand, when the three electron beams are horizontally deflected by the horizontal deflection magnetic field, the horizontal converging effect is exerted on the three electron beams as above. In this case, however, since the quadrupole magnetic field is closer to the phosphor screen than the electron gun end of the horizontal deflection magnetic field, the positions of the three electron beams in the quadrupole magnetic field change according to the amount of deflection. Therefore, the three electron beams are affected by the quadrupole magnetic field with different intensities. Here, when compared with the case where the three electron beams are not horizontally deflected, the horizontal converging effect acting upon the three electron beams weakens. In detail, the converging effect of the magnetic lens weakens from the center to the periphery in the horizontal direction in the quadrupole magnetic field. In other words, the magnetic lens has an intensity distribution such that the converging effect becomes weaker as the distance from the center increases in the horizontal direction. When the three electron beams are deflected more in the horizontal direction, they pass through a part of the quadrupole magnetic field where the converging effect is weaker. Thus, the three electron beams are subjected to a weaker converging effect in the periphery than in the center in the horizontal direction.

With such a construction, the three electron beams can be converged at a farther point in the horizontal edges of the phosphor screen than in the center. Accordingly, in a color picture tube device in which the distance between the electron gun and the phosphor screen is greater in the horizontal edges than in the center of the phosphor screen, proper convergence can be produced in the horizontal edges of the phosphor screen. This is achieved by the intensity distribution of the magnetic lens. Hence there is no need to vary the converging effect of the magnetic lens in sync with the horizontal deflection. Of course it is possible to vary the converging effect in sync with the horizontal deflection. However, this causes problems such as higher power consumption and greater circuit load, since the horizontal deflection frequency is high. According to the present invention, however, convergence can be produced using a simple construction without having to vary the converging effect in sync with the horizontal deflection.

As described above, the resolution can be improved with a simple construction having the following four features.

(a) A substantially uniform magnetic field is used as the horizontal deflection magnetic field.

(b) The three electron beams are in substantially parallel with each other along the tube axis when entering the deflection magnetic field region.

(c) A magnetic lens that exerts a horizontal converging effect on the three electron beams is generated between the electron gun end of the ferrite core of the deflection yoke and the phosphor screen.

(d) Any unnecessary vertical effect of the magnetic lens is canceled out by the magnetic field distribution of the vertical deflection magnetic field.

In this way, convergence can be easily realized throughout the phosphor screen, irrespective of whether the electron beams are aimed at a point in the horizontal center or horizontal edges of the phosphor screen.

If convergence cannot be adjusted sufficiently when the electron beams are vertically deflected, it is preferable to employ a construction that weakens the horizontal converging effect or vertical diverging effect of the magnetic lens in accordance with the intensity of the vertical deflection magnetic field. For example, the effect of the magnetic lens may be varied in sync with the vertical deflection. Since the vertical deflection frequency is low around several tens of Hz, varying the horizontal converging effect or vertical diverging effect of the magnetic lens in sync with the vertical deflection causes neither higher power consumption nor more complex circuit construction. Also, the magnetic lens may be modified so as to have an intensity distribution such that the horizontal converging effect becomes weaker as the distance from the center increases in the vertical direction.

Modifications

The present invention has been described by way of the above embodiment, though it should be obvious that the invention is not limited to the above. Example modifications are given below.

Figure 13:
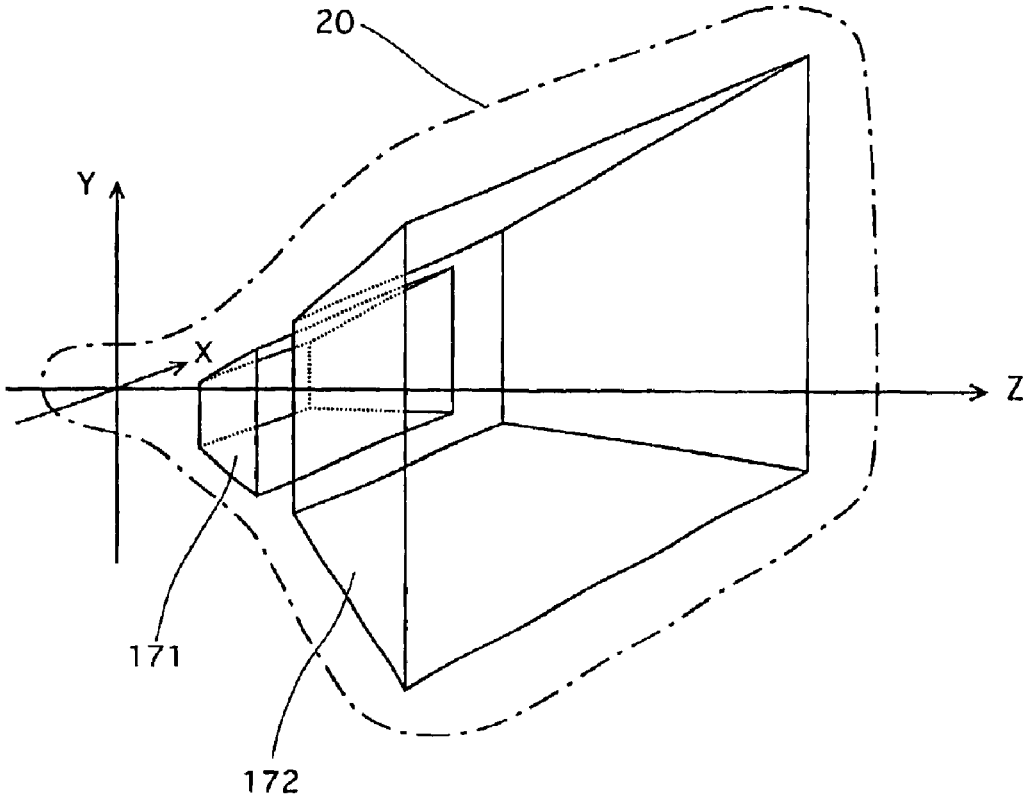
FIG. 13 shows an example of using an electrostatic lens.

(1) The above embodiment describes the case where the quadrupole magnetic field formed by the coils is used as the lens, but the invention should not be limited to such. For instance, an electrostatic lens may be used so long as it has an appropriate intensity distribution and a horizontal converging effect. FIG. 13 shows an example of using such an electrostatic lens. In the drawing, a shield member provided in the funnel 20 is separated into a shield 171 on the electron gun side and a shield 172 on the phosphor screen side, which are given different potentials. Then an electrostatic lens can be provided in the gap therebetween. Here, it is preferable to optimize specific constructions such as the levels of the potentials and the shape of the member in consideration with other conditions. Alternatively, an electrostatic lens and a magnetic lens may be used in combination. In this case, the electrostatic lens can be used to make fine adjustments of the convergence produced by the magnetic lens.

(2) The above embodiment describes the case where the coils are provided to generate the quadrupole magnetic field. However, if there is no need to modulate the magnetic field intensity in sync with the vertical deflection, magnets may equally be used to generate the quadrupole magnetic field. In such a case, it is desirable to use magnets with low temperature coefficients that exhibit excellent temperature characteristics. It is also possible to form coils by winding conductors on the magnets and then make fine adjustments.

(3) The above embodiment describes the case where the two coils are provided above and below the electron beams to generate the quadrupole magnetic field, but the present invention is not limited to such. For example, two coils may be provided left and right of the electron beams, or four coils may be provided diagonally with respect to the electron beams. Also, a sextupole magnetic field or an octupole magnetic field may be used instead of the quadrupole magnetic field. In any case, the magnetic poles should be positioned in such a way as to generate a force of converging the three electron beams in the horizontal direction. Furthermore, it is preferable to control the flowing out of the magnetic flux, as described above.

(4) The quadrupole magnetic lens has a vertical diverging effect, as mentioned above. Basically, such a vertical diverging effect can be canceled out or reduced through the use of the magnetic field distribution of the vertical deflection magnetic field. As an alternative, the intensity of the lens itself may be weakened as the amount of vertical deflection increases. These two methods may also be used in combination. However, if more precise convergence is required, it is necessary to solve the following problem associated with the vertical effect of the lens.

Figure 14:
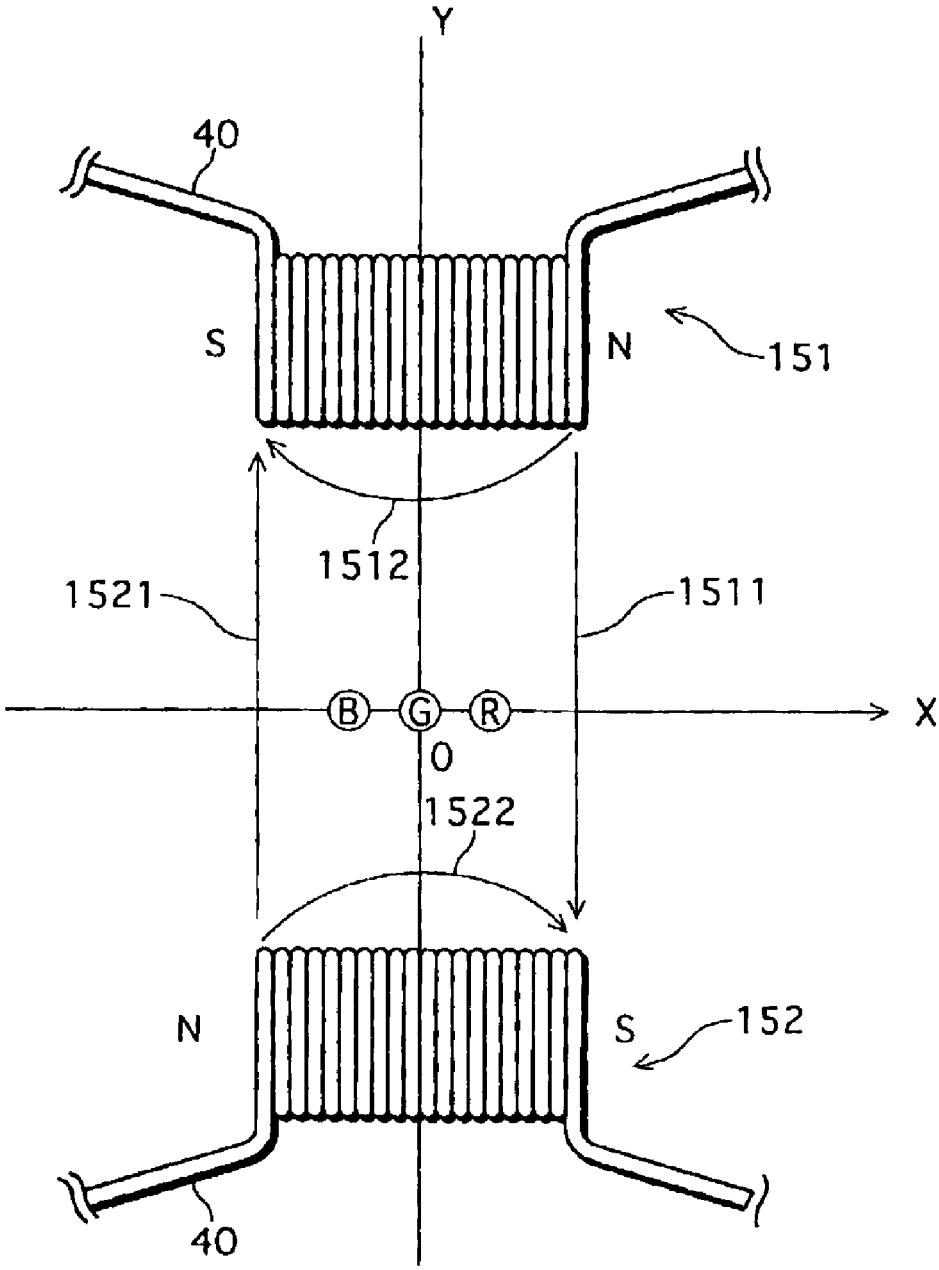
FIG. 14 is a representation of a magnetic field generated between both poles of an upper coil and a magnetic field generated between both poles of a lower coil shown in FIG. 2.

FIG. 14 shows a magnetic field 1512 formed between the two poles of the upper coil 151 and a magnetic field 1522 formed between the two poles of the lower coil 152. When the quadrupole magnetic lens is used, these magnetic fields 1512 and 1522 have a vertical diverging effect of moving the three electron beams away from the center in the vertical direction. Such a lens effect may not be able to be canceled out using the magnetic field distribution of the vertical deflection magnetic field alone. The magnetic field 1512 has an upward effect on the electron beams, whilst the magnetic field 1522 has a downward effect on the electron beams. Besides, the intensity of such an effect differs for each electron beam. This causes misconvergence. Therefore, when the effects of these magnetic fields 1512 and 1522 are not negligible, a mechanism for canceling out or reducing the magnetic fields 1512 and 1522 in sync with the vertical deflection may be provided.

(5) The above embodiment describes the case where the electron gun 30 emits the three electron beams in substantially parallel with each other, but this is not a limit for the present invention. For instance, an electron gun that emits the two outer beams in an inward direction may be used. In such a case, after the electron gun emits the three electron beams, the paths of the electron beams are modified using a simple magnetic field generation device such as a widely-used convergence yoke (the magnetic field mentioned here differs from a deflection magnetic field), so as to make the electron beams substantially parallel with each other.

(6) The above embodiment describes the case where the quadrupole coil 150 is provided in the deflection yoke 100 to form the magnetic lens, but the magnetic lens may be provided in an area different from the deflection magnetic fields. For example, the magnetic lens may be provided between the phosphor screen and the deflection yoke 100.

(7) The above embodiment describes the use of one lens. However, if a plurality of such lenses are provided in the direction of the tube axis, design freedom increases. Especially when at least one lens is formed in the core of the deflection yoke and at least one remaining lens is formed between the core of the deflection yoke and the phosphor screen, convergence and raster distortion can be independently adjusted. This enables both adjustments to be made favorably.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A color picture tube device that deflects a plurality of electron beams and produces a color image on a phosphor screen, comprising:

an electron gun having a plurality of in-line cathodes, and emitting the plurality of electron beams;

a deflection yoke including a horizontal deflection coil, a vertical deflection coil, and a core, the horizontal deflection coil generating a horizontal deflection magnetic field that is substantially uniform, and the vertical deflection coil generating a vertical deflection magnetic field; and a lens forming unit forming a lens which the plurality of electron beams pass through, the lens being positioned between an end of the core facing the electron gun and the phosphor screen, wherein the plurality of electron beams are substantially parallel with a tube axis of the color picture tube device, when passing the end of the core facing the electron gun, and the lens has (a) a horizontal converging effect of causing the plurality of electron beams to approach each other in a horizontal direction regardless of which part of the phosphor screen the plurality of electron beams reach, and (b) an intensity distribution such that the horizontal converging effect becomes weaker as the part of the phosphor screen which the plurality of electron beams reach is more distant in the horizontal direction from a vertical center line of the phosphor screen.

2. The color picture tube device of claim 1, wherein the lens has the horizontal converging effect of causing the plurality of electron beams to converge on the phosphor screen, when the part of the phosphor screen which the plurality of electron beams reach is on or around a horizontal center line of the phosphor screen.

3. The color picture tube device of claim 1, wherein the lens has the horizontal converging effect of causing the plurality of electron beams to approach each other in the horizontal direction, when the plurality of electron beams are not deflected by any of the horizontal deflection magnetic field and the vertical deflection magnetic field.

4. The color picture tube device of claim 1, wherein positions at which the plurality of electron beams pass through the lens change in the horizontal direction, as the plurality of electron beams are horizontally deflected by the horizontal deflection magnetic field.

5. The color picture tube device of claim 1, wherein the lens is a magnetic lens.

6. The color picture tube device of claim 5, wherein a strength of the horizontal converging effect is adjusted by a magnetic flux density distribution of the magnetic lens.

7. The color picture tube device of claim 5, wherein a principal surface of the magnetic lens is positioned around a deflection center of the horizontal deflection magnetic field.

8. The color picture tube device of claim 5, wherein the magnetic lens is a quadrupole magnetic lens.

9. The color picture tube device of claim 5, wherein the lens forming unit includes at least one magnetic member which is any of a magnet, a magnet coil, and a combination of a magnet and a magnet coil.

10. The color picture tube device of claim 9, wherein the lens forming unit includes two magnetic members, and forms a quadrupole magnetic lens as the magnetic lens by positioning the two magnetic members so that a south pole of each magnetic member faces a north pole of the other magnetic member.

11. The color picture tube device of claim 10, wherein the two magnetic members are separately positioned above and below an area where the plurality of electron beams pass through.

12. The color picture tube device of claim 11, wherein four poles of the quadrupole magnetic lens are positioned at four vertices of a rectangle whose center corresponds to a point which a central electron beam passes when the plurality of electron beams are not deflected by any of the horizontal deflection magnetic field and the vertical deflection magnetic field, and an angle $\alpha$ formed by a first straight line and a second straight line satisfies $10° < \alpha < 35°$, the first straight line connecting the center of the rectangle and midpoints of upper and lower sides of the rectangle, and the second straight line connecting the center of the rectangle and any vertex of the rectangle.

13. The color picture tube device of claim 9, wherein the at least one magnetic member is embedded in an insulating frame that is provided between the horizontal deflection coil and the vertical deflection coil.

14. The color picture tube device of claim 5, wherein the magnetic lens is formed by a coil wound on the core.

15. The color picture tube device of claim 5, wherein the vertical deflection magnetic field is shaped like a barrel.

16. The color picture tube device of claim 1, wherein the horizontal converging effect is strongest when the plurality of electron beams are not deflected by any of the horizontal deflection magnetic field and the vertical deflection magnetic field.

17. The color picture tube device of claim 16, wherein the horizontal converging effect weakens as the plurality of electron beams are vertically deflected more by the vertical deflection magnetic field.

18. The color picture tube device of claim 17, wherein the horizontal converging effect is adjusted using a vertical deflection current.

19. The color picture tube device of claim 1, wherein the lens includes an electrostatic lens.

20. The color picture tube device of claim 19, wherein the lens is positioned between an end of the core facing the phosphor screen and the phosphor screen.

* * * * *